United States Patent [19]

Solheim

[11] Patent Number: 4,649,872

[45] **Date of Patent: * Mar. 17, 1987**

[54] STRATIFIED COMBUSTION ENGINE

[76] Inventor: Russell G. Solheim, 1100 Indiana St., Racine, Wis. 53405

[ * ] Notice: The portion of the term of this patent subsequent to Aug. 17, 1998 has been disclaimed.

[21] Appl. No.: 285,374

[22] Filed: Jul. 20, 1981

[51] Int. Cl.[4] ..... F01L 1/28

[52] U.S. Cl. ..... 123/79 C; 123/151; 123/430; 123/432

[58] Field of Search ..... 123/79 R, 79 C, 151, 123/296, 430, 432

[56] References Cited

U.S. PATENT DOCUMENTS

| | | | |
|---|---|---|---|
| 2,049,186 | 7/1936 | Zahodiakin | 123/151 |
| 2,125,213 | 7/1938 | Anderson | 123/79 R |
| 2,303,324 | 12/1942 | Brumby | 123/79 C |
| 3,180,327 | 4/1965 | Neir | 123/151 |
| 4,064,849 | 12/1977 | Nagasawa | 123/432 |
| 4,106,439 | 8/1978 | Kanao | 123/430 |
| 4,162,663 | 7/1979 | Ehrlich | 123/430 |

FOREIGN PATENT DOCUMENTS

| | | | |
|---|---|---|---|
| 0237637 | 10/1921 | Fed. Rep. of Germany | 123/432 |
| 1200816 | 12/1959 | France | 123/79 C |

*Primary Examiner*—Willis R. Wolfe, Jr.
*Attorney, Agent, or Firm*—Arthur J. Hansmann

[57] ABSTRACT

Combustion engine having a cylinder and a piston movable therein and having a spark plug for igniting the combustible fuel. Three valves are concentricly located coaxially with the spark plug for separately controlling the flow of incoming fresh air to the cylinder and the flow of the fuel mixture to the cylinder and the flow of the exhaust gases from the cylinder. The engine presents the necessary valve seat for the exhaust valve, and the other two valves are also provided with valve seats, and springs urge each of the valves toward their respective seated positions. Also, push rods and rocker arms are arranged for opening the valves, as required. The entire arrangement provides for introducing a layer of clean air next to the cylinder wall and then introducing the fuel mixture into the center of the cylinder and adjacent the spark plug. Upon firing, the flame is primarily confined by the boundary of fresh air, and the flame is thus away from the cylinder wall. The exhaust gas then moves from the region adjacent the cylinder wall and out of the cylinder.

11 Claims, 6 Drawing Figures

STRATIFIED COMBUSTION ENGINE

The invention relates to a stratified combustion engine of the type wherein multiple layers of different gases are introduced into the engine.

BACKGROUND OF THE INVENTION

The prior art is already aware of combustion engines having various arrangements of valves for controlling the flow of gases into and out of the engine. Some examples of prior art engines are seen in U.S. Pat. Nos. 2,049,186 and 2,935,055 and 2,962,009 and U.S. Pat. Nos. Re. 26,603 and 3,418,981 and 3,973,530 and 4,106,439. Of the aforementioned patents, the first three relate to valve arrangements and gas flows which cool the exhaust valve, and the latter one shows two concentric exhaust valves. The remainder of the aforementioned patents mention the control of the gas flows so that the fuel-air mixture and the additional or auxiliary air are introduced at different locations within the cylinder. However, the prior art does not disclose an arrangement of gas flow and valving such that there is stratification to the extent that the fuel-air mixture is introduced at the center of the cylinder and the auxiliary or fresh air is at the cylinder wall, all for the purpose of containing the combustion flame to the center of the cylinder and thereby provide improved efficiency and to also provide cooling for the engine and particularly the exhaust valve. As such, the present invention differs from the prior art.

Further distinction over the prior art is incorporated in the following recitation regarding the operation of the engine of this invention.

On the suction or intake stroke, the air valve and the fuel-air valves are opened and move away from their respective seats. The air flows from the air valve against the inner wall of the cylinder and follows it down by Coanda effect in a spiral motion given to it by exhaust valve turning vanes and forms a boundary layer there. The thickness of the boundary layer can be altered by varying the amount of air allowed to enter the air valve. The spiral action of the air movement causes the air to remain adjacent to the cylinder wall by centrifugal action as the piston descends.

The fuel-air mixture at the same time is drawn into the cylinder in the center of the cylinder and adjacent to the spark plug. As the fuel-air mixture passes through the fuel-air passage it cools the spark plug holder and the fuel-air valve and at the same time the mixture is more fully vaporized.

On the compression stroke the air continues to rotate and causes some degree of rotation of the central fuel air mass and at the interface a lean mixture is formed. Because of the large valves, the intake valves can close sooner after bottom dead center (BDC) than in the usual engine. With the valves closed the piston rises and compresses the air and fuel-air-mixture in a stratified manner. A concentric ring of boundary air having no fuel remains next to the cylinder wall, the fuel-air mixture remains in the center, and a lean mixture of fuel-air exists at the interface.

When the spark plug fires, a circular flame front begins to spread equally in all directions. When the flame front passes through the fuel air mixture and the lean mixture at the interface, a cushion of air remains to prevent knocking. Because of this arrangement, higher compression ratios may be obtained without knocking.

As the piston descends during the expansion stroke, less heat is given up to the cylinder walls because of the layer of insulating air that lies next to the cylinder wall. Also, since gasoline vapors do not impinge on the film of lubricating oil on the inner wall of the cylinder, this oil will tend to remain in place for better lubrication and the result will be reduced friction between the piston rings and piston and the cylinder wall. In addition, a lower viscosity oil may be used. Less oil will be consumed and the piston rings will have longer life.

The piston can descend more toward B.D.C. before the exhaust valve opens because of the large exhaust valve. The advantages of the "more complete expansion" engine concept can be realized without supercharging.

As the piston rises on the exhaust stroke, the hot gases as well as the peripheral air are exhausted through the exhaust valve. The exhaust valve will not get as hot as the usual valve because it is cooled very well by means of the two large seats and because of the heat being absorbed by the air passing through the air valve.

The exhaust valve would be held open past top dead center (T.D.C.) as in a conventional engine and the intake air and fuel-air valves would open just before T.D.C. to provide improved scavenging of the exhaust gasses. Little or no fuel-air mixture will escape out of the exhaust because the fresh air valve will be open and will be the primary source of purge air. Cam timing can be arranged to allow the fuel-air mixture to enter the cylinder to force the residual gases in the center of the cylinder TOWARD the exhaust valve opening. The exhaust valve will close before the fuel-air mixture reaches it.

As the fuel-air valve opens, the fuel-air mixture impinges on the electrodes of the spark plug and assists in keeping it free of dirt, oil, and moisture. This will assure constant correct firing of the spark plug. The spark plug is centrally located so as to provide the shortest possible distance for the flame front to travel. This, together with the air cushion at the perimeter of the cylinder and higher compression should provide fast burning of the charge without knocking. Greater power and economy of operation of the engine will result.

Because of the large diameter valves, reduced pumping losses should be realized, reduced pressure drop across the valves, and a greater influx of air and fuel-air especially at the higher speeds will be admitted to the cylinder per unit of time.

The objects and features and advantages of this invention are listed as follows:

1. Higher compression without knock and the reduced possibility of pre-ignition.
2. Greater power and economy.
3. Later opening of exhaust valve on power stroke for greater efficiency (due to the quick opening valve and its large area).
4. Less pumping loss due to the large exhaust valve area.
5. Earlier closing of intake ports after B.D.C. and less pumping loss due to large intake valves.
6. Due to the unique stratified charge arrangement, improved efficiency of burning of fuel will result.
7. The exhaust valve will be cooler because of the following:
   a. The close proximity of the seat to the water or air-cooled block.
   b. The adjacent layer of air in which no combustion takes place.

c. The large circumference of contact between the exhaust valve and the head and that between the exhaust valve and the air valve.

d. The cooling due to the adjacent air in the passage between the air valve and the exhaust valve.

e. The air passing over the exhaust valve turning vanes.

f. The air passing through the holes in the exhaust valve which cools the upper portions of the exhaust valve and the exhaust valve spring.

8. Excellent atomization of fuel just prior to entering the cylinder due to impingement of fuel on the spark-plug holder, the fuel-air valve and on the warm passages of the head.

9. Adequate cooling of the head by means of the air and air-fuel mixture passing through it. (Water cooling can be added if required).

10. No fuel adjacent the cylinder walls and consequently no burning there resulting in less heat loss to the cylinder walls.

11. Little or no fuel loss through the exhaust valve during scavenging.

12. The corner between the cylinder wall and the head is heated immediately after the engine is started to eliminate possible hydrocarbon buildup at this location especially when the engine is cold.

13. This engine will warm up very fast, requiring little or no choking.

14. No catalytic equipment will be necessary due to the complete burning of the fuel with either a cold or warm engine.

15. This design lends itself to air cooling and possible elimination of cooling water, the radiator, hoses, pump and alcohol. (It would at least reduce the amount of radiation required). This would result in a substantial saving in weight.

16. In a new engine design, only a new head would be required. The block and all other parts can remain essentially the same.

17. Central location of the spark plug provides a uniform flame front and a short flame front travel resulting in rapid combustion necessitating less spark advance.

18. The spark plug will be self-cleaning by means of the fuel air blast across the electrodes resulting in uniform ignition of the charges.

19. Because no fuel exists next to the cylinder walls, the oil is not washed away, there is no crank-case dilution, no combustion of the oil, and as a result, the viscosity of the oil can be specified to a lower value with resultant reduction of piston and ring friction. Also, less heat is lost to the cooling water of the block.

20. A smaller engine can be developed with the same horsepower of existing engines.

21. Higher RPM is possible.

22. This engine will burn the fuel efficiently and thus there will be less CO, less hydrocarbons and less $NO_2$ emitted to the atmosphere. (There will be less $NO_2$ because the engine would not operate at the high pressure and temperature of a diesel engine).

23. This engine can operate very well on gasohol or alcohol. The alcohol or gasohol droplets will be vaporized primarily in the head but also with the assistance of the usual "hot spot" interface between the exhaust manifold and intake manifold. Thus excellent vaporization occurs and at the same time the head and valves are cooled. The alcohol or gasohol droplets will be vaporized in the head by impingement against the hot fuel-air valve and the spark plug holder and fast warm up will be possible.

24. The compression ratio can be increased to a high value with the use of alcohol because of the combination of its high anti-knock quality and the blanket of air next to the cylinder wall which serves as a cushion or dampening device.

25. The block can be made of reinforced fiberglass epoxy or polyester or other high temperature resistant plastics which will result in a great reduction in weight per unit of HP. This will be possible because of the insulating quality of the blanket of air adjacent to the cylinder wall.

26. Because of the lighter weight engine, the understructure of the engine (engine supports etc.) can be made lighter thus reducing further the weight of the automobile.

SUMMARY OF THE INVENTION

The present invention provides an engine in which separate bodies of working fluid are held in stratified relation prior to compression and combustion by means of a system of circulation in which one body of working fluid is placed in circulation about the axis of the working cylinder in a plane substantially normal to said axis and in contact with the cylinder wall while a second body of working fluid consisting of a combustible mixture is introduced along said axis within the first body of fluid to be separated thereby from contact with said cylinder wall, the fluids being compressed, the second fluid being ignited and allowed to expand, after which the products of combustion are exhausted from the region close to the cylinder wall so that said region is warmed promptly upon starting of the engine and no quenching zone is offered to the flame resulting from the next charge, even before the engine is thoroughly warmed up.

The arrangement of the necessary valves is such that they are effectively cooled by the incoming working fluids, and, since the valves occupy substantially the whole area of the cylinder head that is exposed to the combustion heat, and are cooled as aforesaid, no water jacket is necessary in the cylinder head.

The angle of the seat of the valve that admits fuel mixture is such that it concentrates the fuel mixture along the axis of the cylinder.

The angle of the air valve seat is such that it directs the air outwardly against the cylinder wall, thereby protecting the wall from the solvent effect of the fuel and also from the extreme heat of the combustion. Furthermore, there is means in the air passageway to impart a rotating motion to the air which will tend further to maintain the air in contact with the cylinder wall.

The exhaust valve opening close to the cylinder wall conducts the exhaust gas close to the wall and in contact with the portion of the cylinder head that is exposed to the cylinder interior at the end thereof.

ADVANTAGES OF THIS INVENTION

1. The exhaust valve has an outwardly inclined seat disposed to release products of combustion through the region of the junction between the annular cylinder wall and the planular cylinder head whereby to heat said region promptly upon starting of the engine.

2. The air intake valve has an outwardly inclined peripheral seat positioned to project a sheet of air against the cylinder wall, to be retained thereagainst by the resulting controlled effect.

3. There will be a throttle in the mixture inlet and a throttle in the air inlet, the throttles being interconnected mechanically, electrically or otherwise, to open or close in predetermined relation to each other.

BRIEF DESCRIPTION OF THE DRAWINGS

FIG. 6 is a sectional view of a fragment of the exhaust valve.

DETAILED DESCRIPTION OF THE PREFERRED EMBODIMENT AND METHOD

The invention will be described as incorporated in a four-stroke-cycle spark ignition engine, but it is to be understood that at least some of the advantages can be realized in connection with other types of engines, for example engines of the compression ignition type in which the cylinder walls might be protected to a considerable degree from the extreme heat of the combustion of the fuel.

Figure 1:
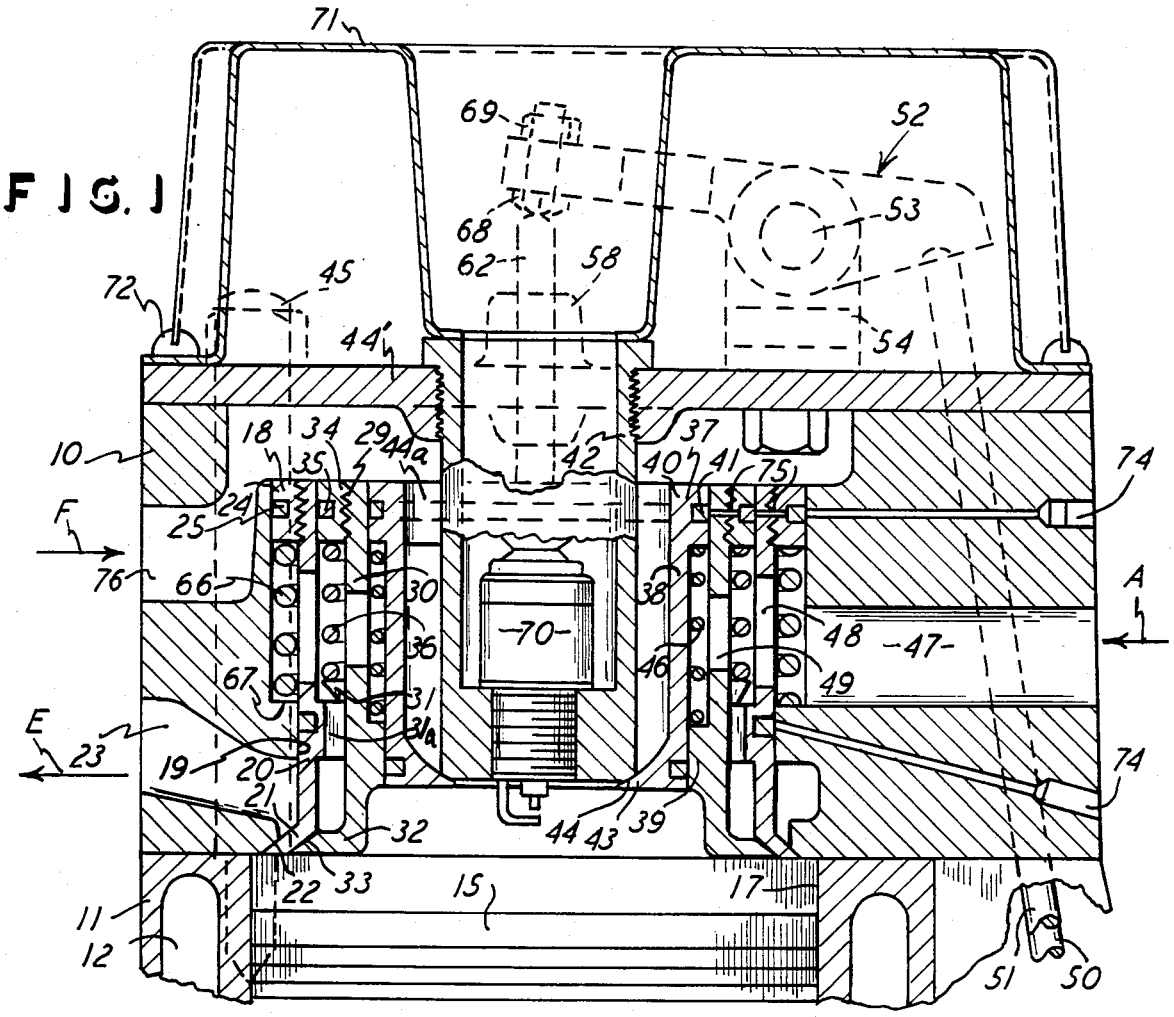
FIG. 1 is a vertical axial cross section of a portion of one cylinder of such an engine with the parts in the positions they would occupy at the end of the compression stroke.
Figure 5:
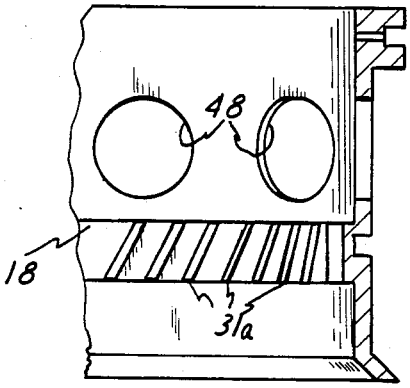

An engine well adapted to accomplish the above outlined operation is shown in detail in FIG. 1, in which 10 is a fragment of the cylinder head which is fastened in conventional manner to a cylinder block 11 having the usual water jacket 12, a piston 15 playing up and down in the cylinder in well known manner.

A large portion of the area of the cylinder head exposed to the bore 17 of the cylinder is occupied by three concentric valves so that only a small area of the head is exposed to the combustion temperature.

Figure 2:
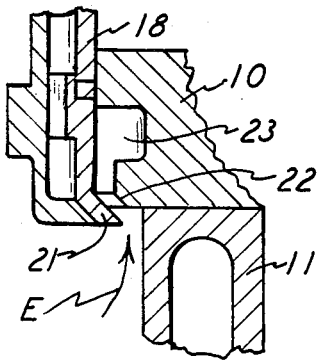
FIG. 2 is a detail of a portion of FIG. 1 showing the positions of the valves during the exhaust stroke.
Figure 4:
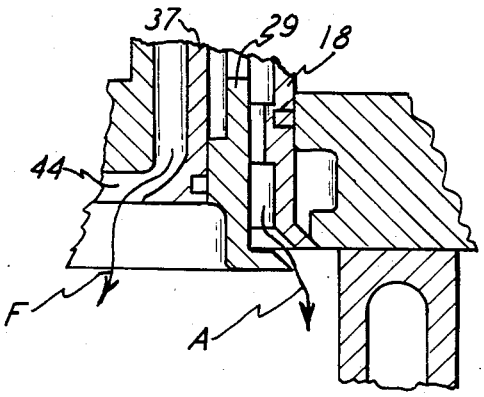
FIG. 4 is a similar view showing the position of all the valves during the intake stroke.

The valves are in the form of concentric sleeves, reciprocable relatively to each other, the outer valve 18 controlling the exhaust and consisting of a sleeve-like stem portion 20 and is reciprocable in a suitable bore 19 in cylinder head 10 and having an outturned rim 21 seated against a seat 22 in head 10. It will be noted that the diameter of the outturned rim is substantially the full diameter of the cylinder bore 17, there being, however, sufficient room between it and the cylinder bore 17 for the exhaust gas to freely escape between the cylinder bore 17 and the rim 21 when the valve is in the open position as seen in FIG. 2.

It is to be noted that, in view of the relatively large diameter of the valve, very little movement of the valve is necessary to form a relatively large opening for the escape of the exhaust gas, which flows into a cavity 23 surrounding sleeve portion 20 and from which it is disposed of in any suitable manner.

Sleeve portion 20 preferably has an upper outwardly extending rim 24 provided with a conventional piston ring 25.

Reciprocable within valve 18 is an air intake valve 29 comprising a sleeve-like stem 30 reciprocable within and guided by a plurality of inwardly projecting vanes 31*a* in sleeve 20 of valve 18, sleeve 30 having an outwardly projecting head portion 32 which seats in a fluid-tight manner against a seat portion 33 of valve 18. Sleeve 30 has an outwardly projecting rim 34 reciprocable in sleeve 20 in a substantially fluid-tight manner and is provided with a piston ring 35. A spring 36 presses downwardly against a ring 31 fixed within sleeve 20 resting on a plurality of inwardly projecting vanes 31*a*, and upwardly against rim 34 to keep valve 29 seated against valve 18 at all times except when opened intentionally by the valve actuating mechanism, to be later described.

Within valve 29 is a third valve or fuel mixture valve 37 having a sleeve portion 38 reciprocable within sleeve 30 of valve 29, and having an outwardly directed rim 40 slidable in sleeve 30 and carrying a piston ring 41 so that rim 40 may reciprocate in sleeve 30 in a substantially fluid-tight manner. Within fuel mixture valve 37 is a stationary spark plug holder 42. Valve 37 also has a lower inwardly directed flange 43 which seats in a fluid-tight manner against a seat 44 formed on the lower extremity of spark plug holder 42, and a plurality of inwardly projecting straightening vanes 44*a* on sleeve 38 serve to direct the flow of mixture and prevent rotating movement of the fluid at this point and when entering the cylinder.

Spark plug holder 42 is fixedly mounted in a plate 44 secured to head portion 10 as by cylinder head bolts 45 which also serve to hold head 10 in place on block 11. In this way spark plug holder 42 is firmly held immovable in relation to head 10.

A spring 46 bears downwardly on above mentioned shoulder 39 and upwardly against rim 40. This maintains inwardly directed flange portion 43 seated against seat 44 on spark plug holder 42 except when otherwise actuated by the valve actuating mechanism. The several springs are graduated in the force they exert, as will be described.

Figure 3:
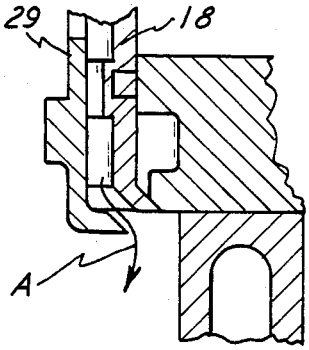
FIG. 3 is a similar view showing the position of the air valve during the intake stroke.

An air inlet passageway 47 in head 10 communicates with one or more holes 48 in sleeve 20 of valve 18 and one or more holes 49 in sleeve 30 of valve 29 so that there is always an ample supply of air when valve 29 is open as seen in FIG. 3.

Figure 5:
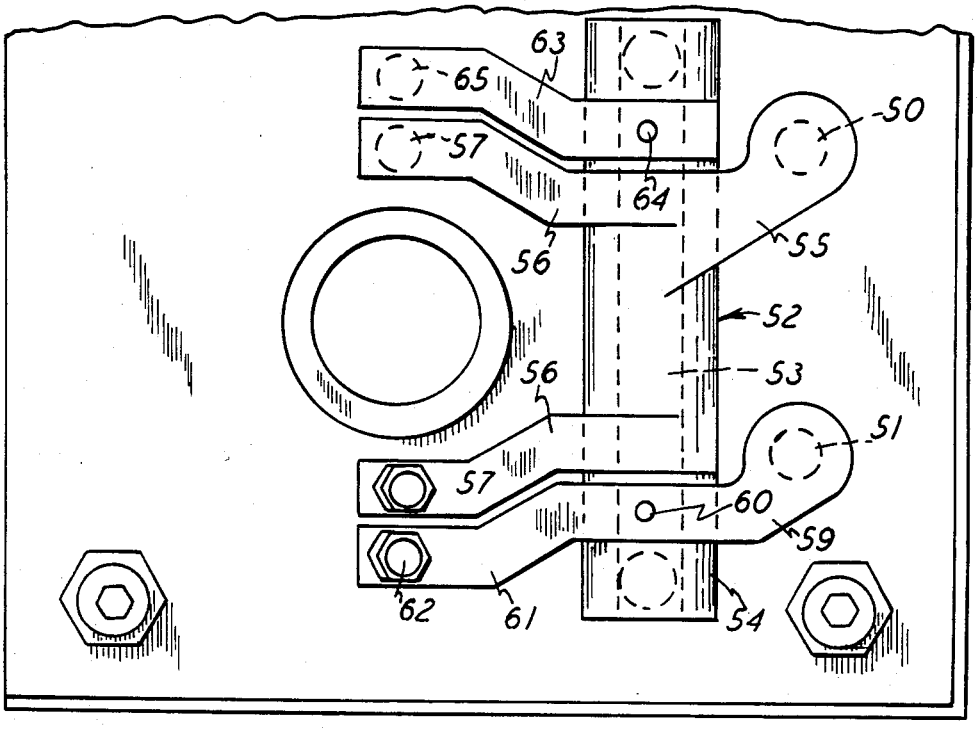
FIG. 5 is a plan view with parts removed showing a detail of the mechanism for operating the valves.

The several valves may be actuated from a conventional cam mechanism not necessary to show or describe, but which operates push rods 50 and 51, FIG. 5. Push rod 50 actuates air intake valve 29 and fuel mixture valve 37 by means of a rocker generally designated as 52 journaled on a hinge pin 53 which is also journaled in bearing elements 54—54 for a purpose to appear, and having an arm 55 to be actuated by push rod 50 and in turn actuating arms 56—56 which engage pins 57—57 slidable in guides 58 formed on plate 44. Pins 57 bear downwardly on rims 34 and 40 in spaced relation on the rims so as to press evenly about the rims and to avoid any tendency to rock the valves and cause them to bind.

Similarly, push rod 51 actuates an arm 59 fixed on hinge pin 53 as by a pin 60 and having an extension arm 61 which presses on a pin 62. Hinge pin 53 also has an arm 63 spaced from arm 61 and fixed to hinge pin 53 by means of a pin 64, and which presses downwardly on a pin 65. Pins 62 and 65 press downwardly at peripherally spaced points against rim 24 of exhaust valve 18.

It will now be apparent that upward movement of push rod 50 will rock rocker 52 and push downwardly on pins 57—57, thus opening air valve 29 and mixture valve 37 while exhaust valve 18 remains closed by a spring 66 bearing upwardly against rim 24 and downwardly against a shoulder 67 formed in bore 19. Later in the cycle when it is necessary to exhaust, push rod 51 will be actuated in a well known manner, rocking arm 61 and, since arm 61 is fixed on hinge pin 53, also rocking arm 63, thus pressing downwardly on pins 62 and 65 and opening valve 18, overcoming spring 66.

It is to be noted that valve 29 will be moved downwardly with valve 18 by reason of the contact of head portion 32 with seat 33 on valve 18, but this is of no consequence, since valve 29 remains tightly seated against valve 18 by the pressure of spring 36 so that no exhaust gas can escape into the air passageways. It is also to be noted that spring 66 is purposely made strong enough to hold valve 18 tightly closed when valves 29 and 37 are opened for the intake phase of the cycle.

To further ensure against uneven pressure against rims 34, 37 and 24, arms 56 and 61 are provided with adjustable tappets as 68, best seen in FIG. 1, each being threaded into its respective arm and having a lock nut 69 bearing against its arm to secure the adjustment. As will be apparent the tappets may be adjusted to secure virtually perfectly even pressure on pins 57, 62 and 65 avoiding any tendency to rock the valves and cause binding.

A suitable or conventional spark plug 70 is seated in the lower extremity of spark plug holder 42 so as to project into the combustion chamber adjacent the lower portions of valves 29 and 37. It is contemplated that an injection nozzle might be located at this point in the event of the use of the invention in a diesel or other modified cycle.

Preferably a cover, which may be of light-weight material 71 encloses the valve actuating mechanism 52 to exclude dirt and avoid inadvertent damage to the mechanism. It is secured to plate 44 by screws 72—72 or other well-known means.

FIG. 6 shows the exhaust valve 18 and particularly vanes 31*a*, affixed thereto and extending between valves 18 and 29. Vanes 31*a* are angled in relation to the longitudinal axis of valve 18, as shown, and they give the air entering the cylinder 11 through the air intake valve 29 a rotary motion about the axis of the sleeves. Also, the vanes 31*a* serve to cool the exhaust valve 18 by conducting heat from the valve and dissipating it to the air entering the cylinder.

The head 10 has oil passageways 74 extending therein and to bore 19 for lubricating. Also, oil passageways 75 extend through the valves 18 and 29 for lubricating.

The gas flow patterns are shown by arrow A, designating the fresh air flow, arrow F, designating the air-and-fuel mixture flow, and arrow E, designating the exhaust flow. The head 10 has a passageway 76 for the air-fuel mixture flow to the valve 37.

What is claimed is:

1. The method of operating an internal combustion engine having a cylinder with an inner wall, which comprises admitting, adjacent said inner wall of said cylinder, a quantity of substantially pure air in a spirally rapidly rotating layer and directing all of said quantity uniformly coaxially relative to said cylinder and toward and against only the adjacent said inner wall of said cylinder, and held thereat by Coanda effect and centrifugal force, while also admitting a quantity of fuel mixture in a non-rotating and non-turbulent manner between the layer of rotating pure air and the longitudinal axis of said cylinder, compressing the rotating pure air and the non-rotating fuel mixture simultaneously and firing the non-rotating fuel mixture and exhausting the products of combustion and pure air uniformly coaxially relative to said cylinder and only from a region adjacent said inner wall and uniformly and completely from said inner wall.

2. An internal combustion engine having a cylinder having an inner wall disposed about a central axis, a head closing one end of the cylinder and having an exhaust valve seat, an exhaust valve seated on said exhaust valve seat, said exhaust valve and said exhaust valve seat being of a diameter to occupy substantially the entire area of the end of said cylinder, an air inlet valve within and seated on said exhaust valve, a fuel mixture valve within said air inlet valve, means fixed with said head extending within said fuel mixture valve substantially to the region of said exhaust valve seat and having a valve seat thereon in the region of said exhaust valve seat, said fuel mixture valve having an inwardly directed flange providing a seat adapted to cooperate in a fluid-tight manner with the seat on said means, a piston reciprocable in said cylinder, and means for actuating said exhaust, said air, and said fuel mixture valves in suitable timed relation to the movements of said piston.

3. The internal combustion engine as claimed in claim 2, wherein said air inlet valve includes an annular flange on the end thereof adjacent said cylinder and extending radially outwardly, and said exhaust valve includes an annular seat in contact with said annular flange, whereby heat is conducted between said exhaust valve and said air inlet valve when said air inlet valve is seated on said exhaust valve.

4. An engine having a cylinder characterized by a longitudinal axis and a coaxial inner wall, a head closing one end of said cylinder and forming a corner therewith, a piston slidable in said cylinder, a seat in said head in said corner and coaxial with said cylinder and of a diameter to occupy substantially entire said corner of said head and said cylinder, an exhaust valve slidable in said head and having an outwardly extending flange coaxial with said cylinder and seatable on said head seat and having a valve seat radially inwardly thereon and coaxial with said cylinder, an air intake valve within said exhaust valve and having an outwardly extending flange coaxial with said cylinder and seatable on said valve seat of said exhaust valve and arranged so that when said air intake valve is unseated all of the air flowing therepast is directed toward said inner wall and coaxially with said cylinder to first sweep residual hydrocarbons and products of combustion out of said corner and subsequently admitting air uniformly to said inner wall at said corner, a spark plug on said head and exposed to the interior of said cylinder, a first passageway in said head and adapted to conduct fuel mixture to said cylinder, a second passageway in said head and adapted to conduct air to said air intake valve, a third passageway in said head and adapted to conduct exhaust gas away from said exhaust valve, and a mechanism for actuating said valve in suitable timed relation to the movements of said piston.

5. The engine as claimed in claim 4, including a spark plug holder coaxial with said cylinder and presenting a seat, a fuel mixture valve slidable in said air intake valve and having a portion thereon coaxial with said cylinder and seatable on said spark plug holder seat for the passage of fuel mixture into said cylinder along the longitudinal axis thereof and within the confines of the air passing through said air intake valve.

6. An engine having a cylinder characterized by an inner wall, a head closing one end of said cylinder, a piston slidable in said cylinder, an exhaust valve slidable in said head and a seat in said head and of a diameter to occupy substantially the entire area of said head that is exposed to the interior of said cylinder, an air intake valve within said exhaust valve and a seat in said exhaust valve, a stationary spark plug holder within said air intake valve and fixed to said cylinder head and extending substantially to the region of said valve seats, a fuel mixture valve slidable in said air intake valve and having an inwardly directed flange seated on said stationary spark plug holder, a spark plug fixed in said spark plug holder and exposed to the interior of said cylinder, a first passageway adapted to conduct fuel mixture to said fuel mixture valve, a second passageway adapted to conduct air to said air intake valve, a third passageway adapted to conduct exhaust gas away from said exhaust valve, and mechanism for actuating said valves in suitable timed relation to the movements of said piston.

7. An engine as set forth in claim 6 in which said valves are coaxial with said cylinder and with each other.

8. An engine as set forth in claim 6 in which said exhaust valve has a sleeve-like stem slidably guided in said head, said air intake valve has a sleeve-like stem slidably guided in the sleeve like stem of said exhaust valve and said fuel mixture valve has a sleeve-like stem slidably guided in said air intake valve.

9. An engine as set forth claim 8 having means for supplying lubricating fluid to the sleeve-like stems of said valves.

10. An engine as set forth in claim 8 in which said air intake valve and said exhaust valve each have a sleeve on a common axis, and with said air intake valve sleeve spaced inwardly from said exhaust valve sleeve and communcating with said second passageway, and a plurality of vanes in the space between said exhaust valve sleeve and said air intake valve sleeve, angled in relation to said axis of said sleeves to give the air entering the cylinder through said air intake valve a rotary motion about said axis of said sleeves.

11. An engine as set forth in claim 10 in which said vanes are fixed on said exhaust valve sleeve whereby heat is conducted from said exhaust valve to the air entering said cylinder for cooling said exhaust valve.

* * * * *

UNITED STATES PATENT AND TRADEMARK OFFICE

CERTIFICATE OF CORRECTION

PATENT NO. : 4,649,872

DATED : March 17, 1987

INVENTOR(S) : Russell G. Solheim

It is certified that error appears in the above–identified patent and that said Letters Patent are hereby corrected as shown below:

On the cover sheet, at "Date of Patent","Notice",

"Aug. 17, 1998" should read -- Aug. 17, 2001 --

Signed and Sealed this

Seventeenth Day of November, 1998

*Attest:*

*Attesting Officer*

BRUCE LEHMAN

*Commissioner of Patents and Trademarks*